US007686122B2

(12) United States Patent
Nakayama

(10) Patent No.: US 7,686,122 B2
(45) Date of Patent: Mar. 30, 2010

(54) EXHAUST SYSTEM AND SADDLE-RIDE TYPE VEHICLE

(75) Inventor: Yoshiharu Nakayama, Shizuoka (JP)

(73) Assignee: Yamaha Hatsudoki Kabushiki Kaisha, Iwata-shi (JP)

( * ) Notice: Subject to any disclaimer, the term of this patent is extended or adjusted under 35 U.S.C. 154(b) by 840 days.

(21) Appl. No.: 11/461,706

(22) Filed: Aug. 1, 2006

(65) Prior Publication Data

US 2007/0181360 A1 Aug. 9, 2007

(30) Foreign Application Priority Data

Aug. 2, 2005 (JP) ..... 2005-224719

(51) Int. Cl.
*B60K 13/04* (2006.01)

(52) U.S. Cl. ..... 180/296; 180/309; 60/323

(58) Field of Classification Search ..... 180/296, 180/309; 60/272, 304, 305, 323
See application file for complete search history.

(56) References Cited

U.S. PATENT DOCUMENTS 4,522,282 A * 6/1985 Yamamoto ..... 180/219
4,604,865 A * 8/1986 Otani et al. ..... 60/293
4,795,420 A * 1/1989 Sakurai et al. ..... 60/313
4,939,898 A * 7/1990 Ichimura et al. ..... 60/274
5,351,481 A * 10/1994 Flugger ..... 60/273
6,742,332 B2 * 6/2004 Piekarski ..... 60/323
7,347,045 B2 * 3/2008 Bozmoski et al. ..... 60/312
7,353,901 B2 * 4/2008 Abe et al. ..... 180/190
7,418,818 B2 * 9/2008 Kato et al. ..... 60/324

FOREIGN PATENT DOCUMENTS

| | | |
|---|---|---|
| JP | 56-143311 | 11/1981 |
| JP | 61-283714 | 12/1986 |
| JP | UM-A-62-34114 | 2/1987 |
| JP | 2004-026007 | 1/2004 |
| JP | 2004-4190684 | 7/2004 |

* cited by examiner

*Primary Examiner*—Ruth Ilan
*Assistant Examiner*—John D Walters
(74) *Attorney, Agent, or Firm*—Rabin & Berdo, PC

(57) ABSTRACT

An exhaust system for a saddle-ride type vehicle provides sufficient volume in a chamber while avoiding interference between the chamber and other parts. The vehicle center of gravity is lowered and differences in exhaust pipe length are reduced. Exhaust pipes are connected to combustion chambers of front and rear cylinder banks of a V-type engine. A chamber is connected to the exhaust pipes and mufflers are connected to the chamber. The chamber has an exhaust pipe connection wall to which the exhaust pipes are connected and opposing muffler connection walls. The mufflers are connected to positions on the muffler connection walls closer to the engine relative to a center in a longitudinal direction of the vehicle.

14 Claims, 9 Drawing Sheets

EXHAUST SYSTEM AND SADDLE-RIDE TYPE VEHICLE

RELATED APPLICATIONS

This application claims the benefit of priority under 35 USC 119 of Japanese patent application no. 2005-224719, filed on Aug. 2, 2005, which application is hereby incorporated by reference in its entirety.

BACKGROUND OF THE INVENTION

1. Field of the Invention

The present invention relates to an exhaust system for a saddle-ride type vehicle.

2. Description of Related Art

Conventionally, some saddle-ride type vehicles such as a motorcycle, a four-wheel buggy, a snowmobile, or the like have a V-type engine, in which two cylinder banks are arranged in a substantially V-type configuration. In such vehicles, an exhaust system having exhaust pipes between combustion chambers of the cylinder banks and a chamber For example, JP-UM-A-62-34114 discloses an exhaust system for a V-type engine of a motorcycle in which a chamber having a cross section in the form of a substantially inverse triangle is arranged below a V-type engine. Exhaust pipes of front and rear cylinder banks are connected to front and rear wall portions of the chamber, which are opposed to each other in a longitudinal direction of a vehicle.

In this system, the cross section of the chamber in the form of an inverse triangle allows the bank angle of the motorcycle to be increased. And, the arrangement of the chamber below the V-type engine allows the exhaust pipes to be substantially equal in length.

However, since the exhaust pipes are connected to the front and rear wall portions of the chamber, interference between the exhaust pipes connected to the rear wall portion and parts (for example, a suspension device and its bracket shown in FIG. 1 of JP-UM-A-62-34114) arranged rearwardly thereof is an issue. Moreover, it is difficult to ensure enough chamber volume since the chamber has a cross section in the form of an inverse triangle and is small-sized in a longitudinal direction of a vehicle.

Also, since the chamber is below the engine, the engine is arranged in an upper region of the vehicle above the chamber. This causes a problem since the engine is a heavy part and the center of gravity of the vehicle cannot be lowered.

If the chamber is in a location other than below the engine, the relatively heavy muffler is also separated from the engine, thus causing a problem in that mass concentration is hindered. Further, when the chamber is in a location other than below the engine, the distance of the front and rear cylinder banks from the front and rear wall portions of the chamber changes, causing a problem in that different exhaust pipe lengths are required.

SUMMARY OF THE INVENTION

The present invention has been thought of in view of these problems and provides an exhaust system that provides sufficient volume in the chamber while avoiding interference between the chamber and other parts, lowers the center of gravity and concentrates the mass for the vehicle, and reduces differences in exhaust pipe length.

One embodiment of the invention is an exhaust system for a saddle-ride vehicle having an engine, a front cylinder bank and a rear cylinder bank. Exhaust pipes are connected the front and rear cylinder banks. A chamber for exhaust gases comprises an exhaust pipe connection wall facing a rear wall in a vehicle longitudinal direction. Ends of all of the exhaust pipes are connected to the exhaust pipe connection wall, and a pair of muffler connection walls are opposed in a vehicle width direction. Mufflers are connected to positions on the muffler connection walls closer to the engine than a center in the longitudinal direction of the vehicle.

In one embodiment, the front cylinder bank is farther from the exhaust pipe connection wall than the rear cylinder bank. Ends of exhaust pipes connected to the front cylinder bank are connected to side portions of the exhaust pipe connection wall of the chamber in the vehicle width direction, and ends of exhaust pipes connected to the rear cylinder bank are connected to center portions of the exhaust pipe connection wall in the vehicle width direction.

In one embodiment, the front cylinder bank is farther from the exhaust pipe connection wall than the rear cylinder bank. Ends of exhaust pipes connected to the rear cylinder bank are connected to the exhaust pipe connection wall at positions more distant than positions to which ends of exhaust pipes connected to the front cylinder bank are connected.

In one embodiment, the front cylinder bank is farther from the exhaust pipe connection wall than the rear cylinder bank. Exhaust pipes connected to the rear cylinder bank have intermediate portions that intersect.

In one embodiment, the front cylinder bank is farther from the exhaust pipe connection wall than the rear cylinder bank. Exhaust pipes connected to the rear cylinder bank have intermediate portions that intersect, and ends of exhaust pipes connected to the rear cylinder bank are connected to the exhaust pipe connection wall at positions more distant than positions to which ends of the exhaust pipes connected to the front cylinder bank are connected.

In one embodiment, the mufflers are connected to positions on the muffler connection walls that are higher than a center of the saddle-ride vehicle in a vertical direction. Preferably, the muffler connection walls are curved convexly toward an outside of the saddle-ride vehicle and the mufflers are connected to positions on the muffler connection walls that are higher than a maximum projection of the saddle-ride vehicle in a width direction.

In one embodiment, the chamber is behind a pivot shaft serving as a center of rotation of a support member that swings and supports a rear wheel of the saddle-ride vehicle in a vertical direction. Preferably, the rear wall of the chamber is opposed to the rear wheel.

According to the invention, all of the exhaust pipes are concentratedly connected to the exhaust pipe connection wall of the chamber, thereby preventing interference between the exhaust pipe connection wall and other parts mounted on the side of the rear wall. Thus, sufficient space is provided between the exhaust pipe connection wall and other parts mounted on a side of the rear wall to prevent interference between the chamber and other parts. A sufficient volume for muffling is ensured by enlarging the chamber in an opposite direction to the exhaust pipe connection wall.

At the same time, since the muffler is connected to a position on the muffler connection wall closer to the engine relative to a center of the saddle-ride type vehicle in the longitudinal direction, the muffler being a heavy part is arranged closer to the engine, lowering a center of gravity of vehicle and concentrating a mass thereof.

According to the invention, the exhaust pipes of the cylinder bank farther from the chamber are connected to opposite sides of the exhaust pipe connection wall in the width direction, and the exhaust pipes of the cylinder bank closer to the chamber are connected to center portions of the exhaust pipe connection wall. Within the chamber, a distance from sides of the exhaust pipe connection wall to the muffler is small and a distance from a center of the exhaust pipe connection wall to the muffler is large, so differences in length among the exhaust pipes is reduced.

According to the invention, exhaust pipes of the cylinder bank closer to the exhaust pipe connection wall are connected to positions of the connection wall more distant than positions of the connection wall to which the exhaust pipes of the cylinder bank farther from the connection wall are connected. Thus, exhaust pipes of the cylinder bank closer to the exhaust pipe connection wall can be lengthened to reduce differences in length among the exhaust pipes.

Further, according to the invention, the exhaust pipes of the rear cylinder bank have intermediate portions intersecting or intertwining with each other outside or inside the chamber. Thereby, the exhaust pipes of the rear cylinder bank can be made more compact and long without being bypassed in the longitudinal direction of the vehicle, so differences in length among the exhaust pipes are further reduced.

In addition, according to the invention, exhaust pipes of the rear cylinder bank have intermediate portions intersecting or intertwining with each other outside or inside the chamber and may be connected to positions of the connection wall more distant than positions of the connection wall to which exhaust pipes of the front cylinder bank are connected. In this case, the exhaust pipes of the rear cylinder bank can be made even more compact and long, so that differences in length among the exhaust pipes are further reduced.

Also, according to the invention, the mufflers are connected to positions on the muffler connection walls that are higher than a center of the vehicle in a vertical direction. Thus, the mufflers can be mounted in high positions and a bank angle of the vehicle can be increased.

Further, according to the invention, the muffler connection walls are curved convexly toward an outside of the vehicle and the mufflers are connected to positions on the muffler connection walls that are higher than a maximum projection of the vehicle in the width direction. Thus, the mufflers projecting in the vehicle width direction are mounted in higher positions, and the mufflers are inclined along the muffler connection walls in the form of a curved surface and inside in the vehicle width direction to enable lessening an extent, to which they project outside the vehicle. As a result, it is possible to further increase a bank angle of the saddle-ride type vehicle provided with the exhaust system.

In addition, according to the invention, the chamber is behind a pivot shaft serving as a center of rotation of a support member that swings and supports a rear wheel in a vertical direction. Thus, the engine and the chamber do not overlap in the vertical, and the engine can be mounted in a low position to lower the center of gravity.

Also, according to the invention, the rear wall of the chamber is opposed to the rear wheel. Thereby, there is enough space between the chamber and the rear wheel to prevent interference between the chamber and the rear wheel. Also, the chamber can be large in size within a range free from interference with the rear wheel, thus providing sufficient volume for muffling.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Figure 1:
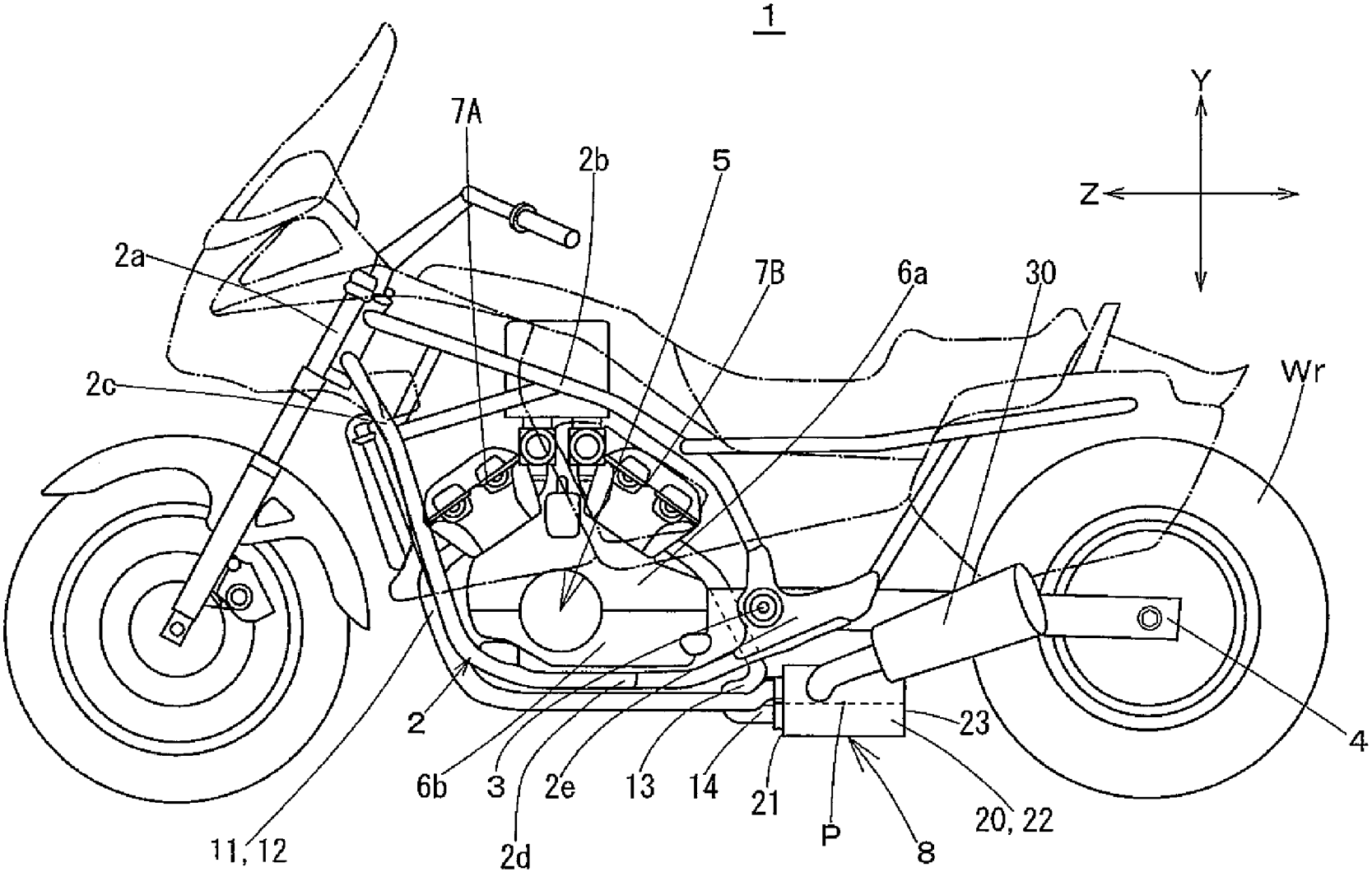
FIG. 1 is a side view of a saddle-ride type vehicle (motorcycle) according to an embodiment of the invention.

An exhaust system and a saddle-ride type vehicle according to an embodiment of the invention are described below with reference to the drawings. First, with reference to FIG. 1, a saddle-ride type vehicle is described on which an exhaust system according to the invention is mounted.

Reference numeral 1 denotes a motorcycle (saddle-ride type vehicle). A frame 2 of motorcycle 1 comprises a steering head pipe 2*a* at a front end thereof. A rearwardly and obliquely downwardly extending main tube 2*b* and a downwardly extending downtube 2*c* are connected to steering head pipe 2*a*. A lower end of downtube 2*c* extends substantially horizontally toward the rear, and a rear end of extension 2*d* is connected to a rear end of main tube 2*b* through a rear arm bracket 2*e*.

A rear arm (support member) 4 is mounted to rear arm bracket 2*e* through a pivot shaft 3 to be able to swing. Rear arm 4 swings vertically about pivot shaft 3 as a center of rotation to support a rear wheel Wr.

A water cooling type 4-cycle V-type 4 cylinder engine 5 is mounted in a space surrounded by main tube 2*b*, downtube 2*c*, and its extension 2*d*. A crankcase 6 of engine 5 is divided into two halves: an upper case 6*a* and a lower case 6*b*. A pair of front and rear cylinder banks (one cylinder bank and the other cylinder bank) 7A, 7B are provided on upper case Ga to face each other in a V-type configuration.

Front and rear cylinder banks 7A, 7B comprise two cylinders (not shown). First to fourth exhaust pipes 11-14, which are part of exhaust system 8, are connected at one end sides thereof to combustion chambers defined by the cylinders of cylinder banks 7A, 7B (not shown).

Exhaust system 8 is now described with reference to FIGS. 1-9. FIG. 2 is a perspective view of exhaust system 8. Exhaust system 8 comprises first to fourth exhaust pipes 11-14, a chamber 20 in the form of an elliptical cylinder that is connected to end sides of exhaust pipes 11-14, and a pair of left and right mufflers 30, 30 connected to chamber 20.

Chamber 20 is arranged rearwardly of or behind pivot shaft 3. Front cylinder bank 7A is relatively distant from chamber 20, and rear cylinder bank 7B is relatively closer to chamber 20. Front and rear wall portions 21, 23 of chamber 20 face each other in a longitudinal direction Z of motorcycle 1. Rear wall portion 23 is arranged in opposition to rear wheel Wr.

First and second exhaust pipes 11, 12 are connected to front cylinder bank 7A, which is further from chamber 20 than bank 7B. One end of exhaust pipes 11, 12 make connections 11*a*, 12*a* to front cylinder bank 7A and have flanges 11*b*, 12*b* that are secured to two bolts embedded in exhaust ports (not shown) of front cylinder bank 7A.

Third and fourth exhaust pipes 13, 14 are connected to rear cylinder bank 7B, which is closer to chamber 20 than bank 7A. In the same manner as described above, one end of exhaust pipes 13, 14 make connections 13*a*, 14*a* to rear cylinder bank 7B and have flanges 13*b*, 14*b*, which are secured to two bolts embedded in exhaust ports (not shown) of rear cylinder bank 7B.

Figure 3:
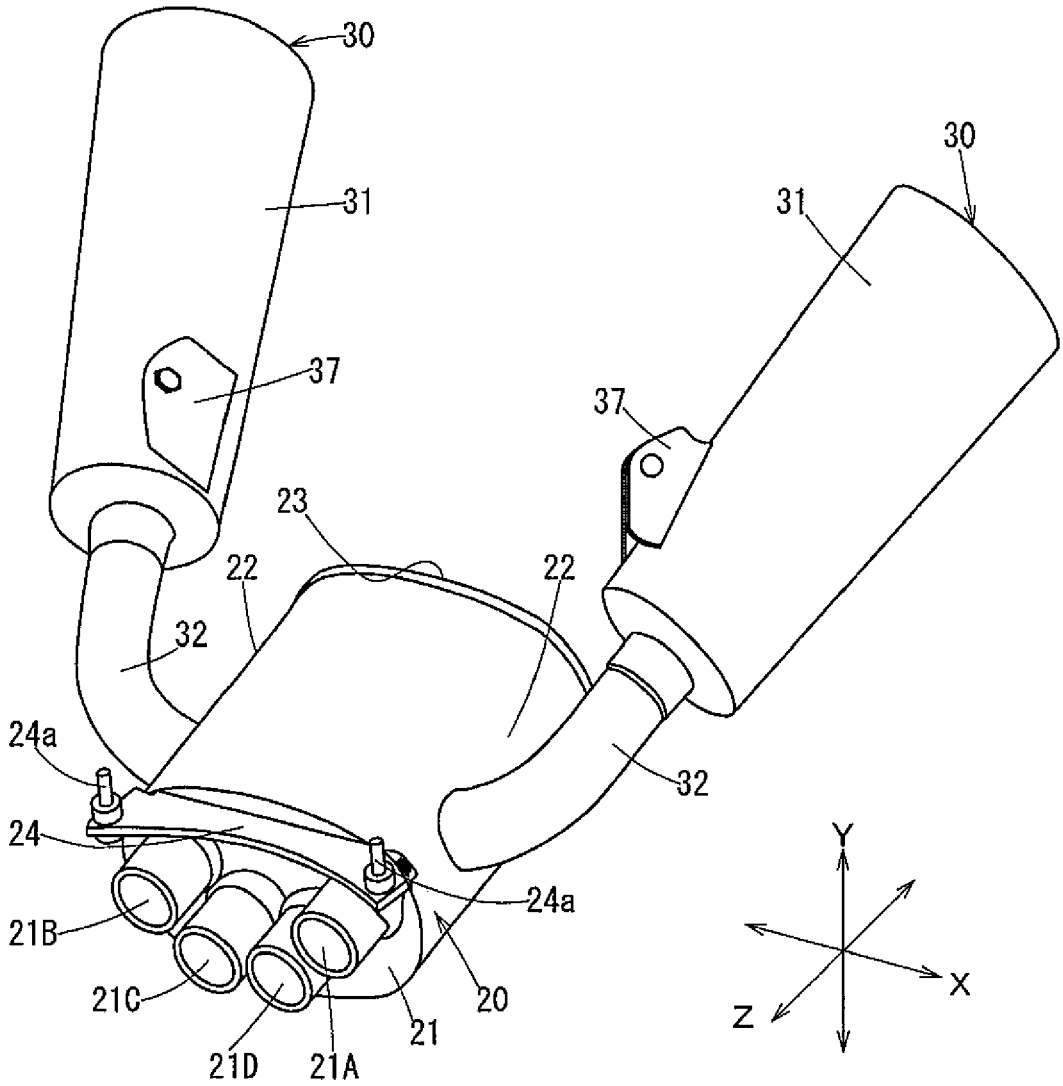
FIG. 3 is a perspective view of a chamber and mufflers, which constitute the exhaust system of the invention.
Figure 4:
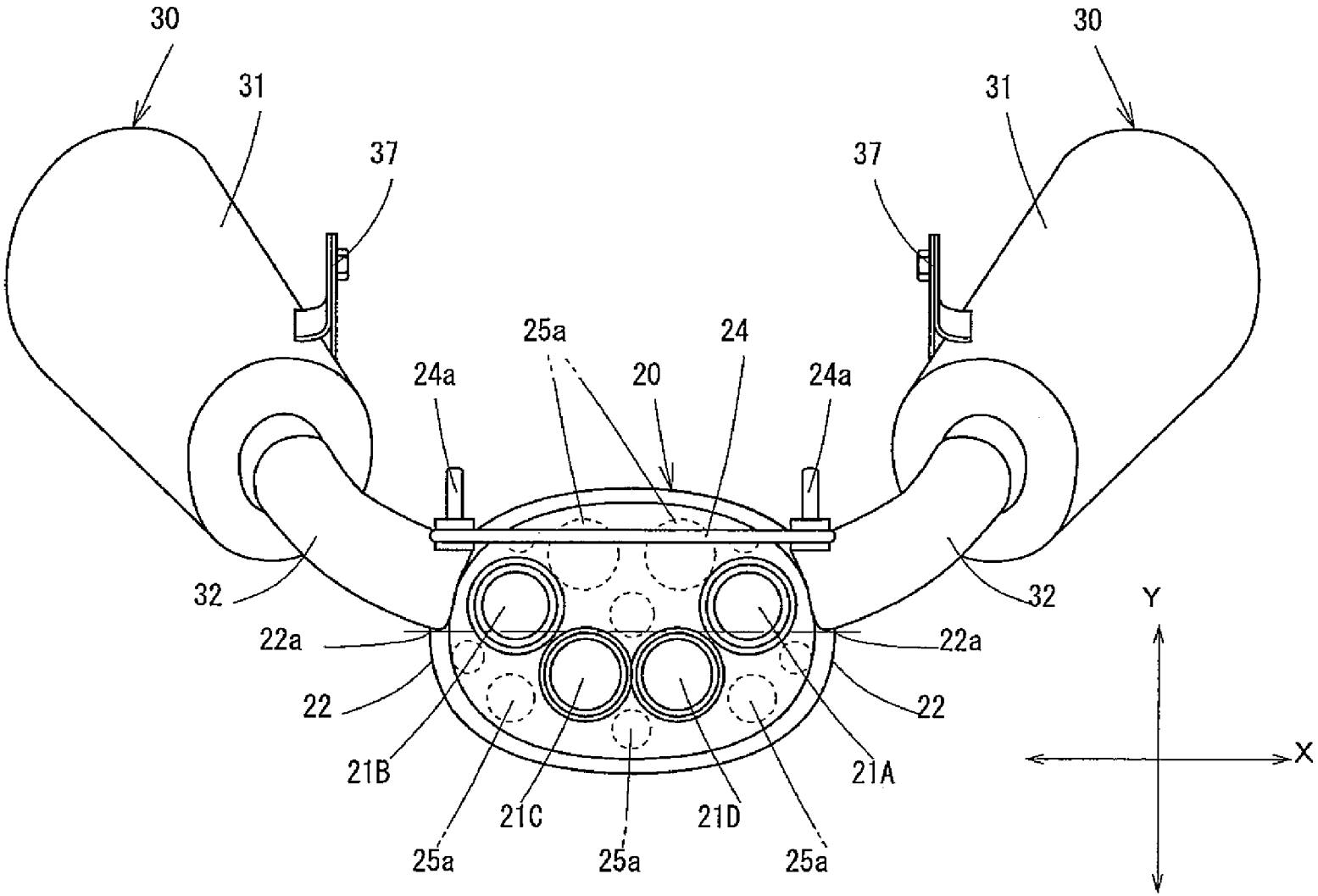
FIG. 4 is a front view of the chamber and the mufflers, which constitute the exhaust system of the invention.
Figure 5:
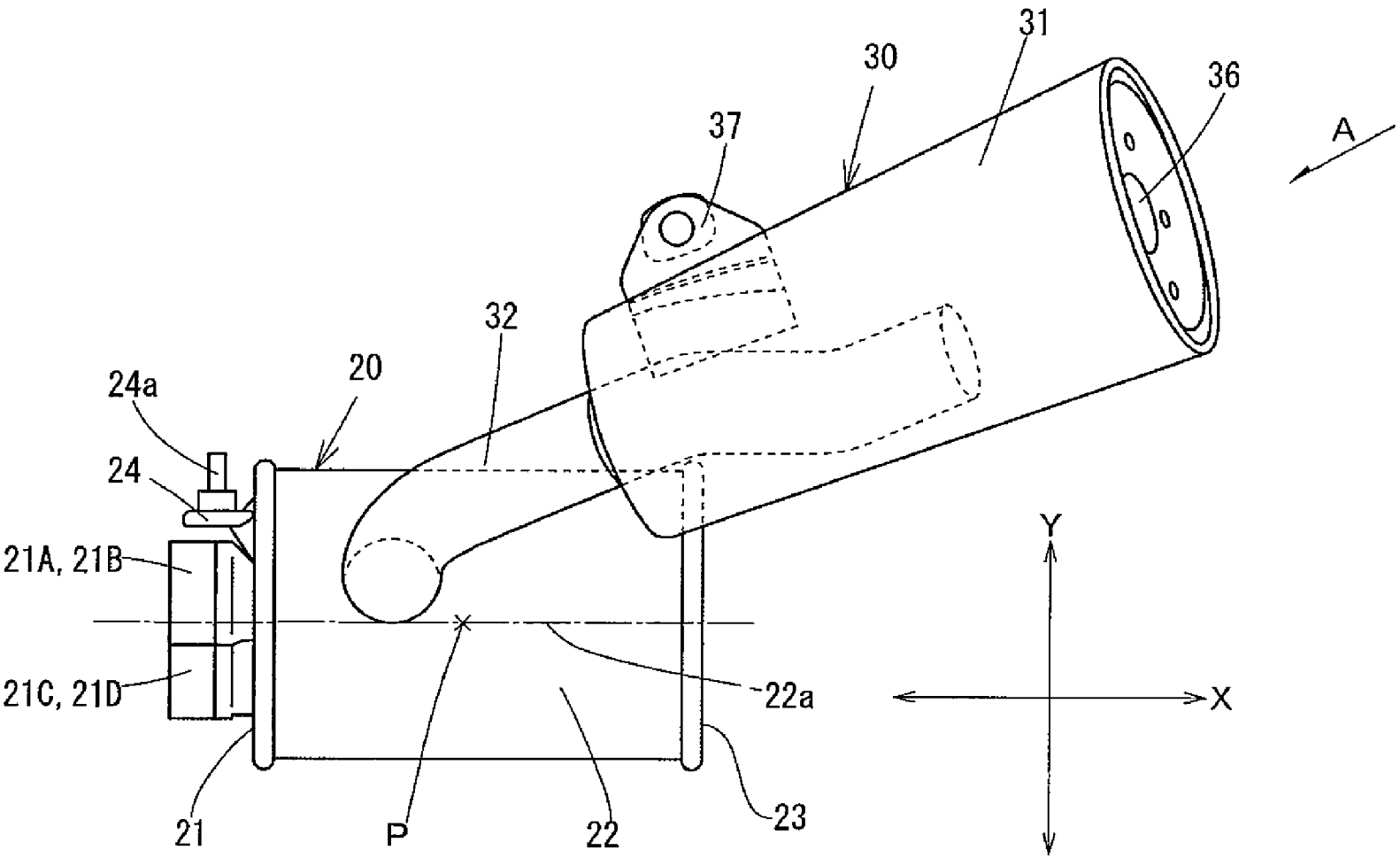
FIG. 5 is a side view of the chamber and the mufflers, which constitute the exhaust system of the invention.
Figure 6:
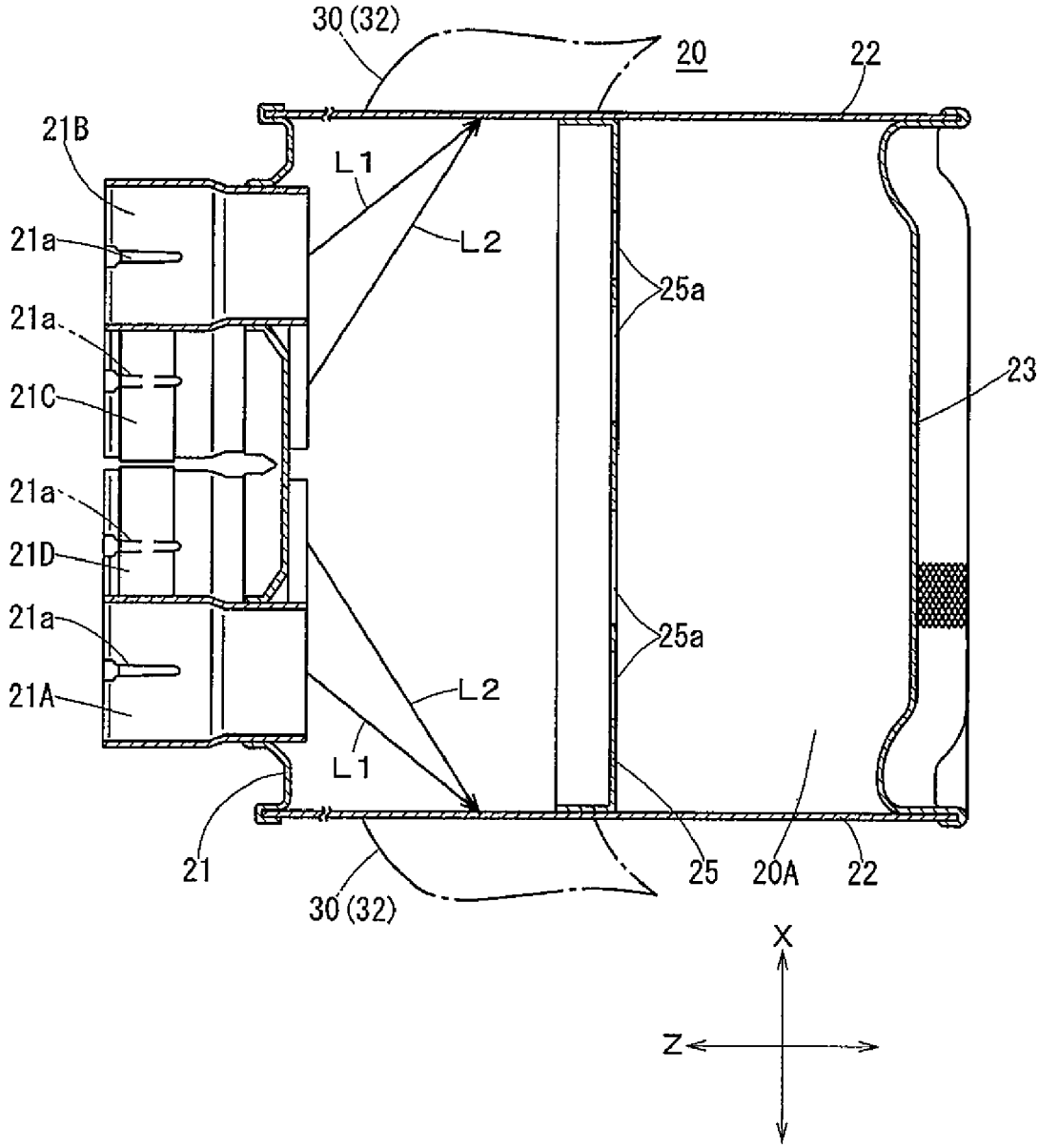
FIG. 6 is a partial, cross sectional view of the chamber of the invention.

FIG. 3 is a perspective view of chamber 20 and mufflers 30 of the exhaust system. FIG. 4 is a front view of chamber 20 and mufflers 30. FIG. 5 is a side view of chamber 20 and mufflers 30. FIG. 6 is a partial, cross sectional view of chamber 20.

Chamber 20 is an elliptical cylinder with a first hollow expansion chamber 20A defined therein that is closed by front and rear wall portions 21, 23. Front wall portion 21 is the exhaust pipe connection wall to which exhaust pipes 11-14 are concentratedly connected.

As described above, chamber 20 is arranged such that exhaust pipe connection wall 21 is relatively distant from front cylinder bank 7A and relatively close to rear cylinder bank 7B. Therefore, exhaust pipes 11, 12 connected to front cylinder bank 7A tend to be longer than exhaust pipes 13, 14 connected to rear cylinder bank 7B. However, as described below, exhaust system 8 adopts various inventive constructions to reduce differences in length among the exhaust pipes.

First, as shown in FIGS. 3-6, first to fourth connections 21A to 21D are arranged on the exhaust pipe connection wall 21 in a width direction X. Ends of first and second exhaust pipes 11, 12 opposite to ends connected to front cylinder bank 7A are connected to first and second connections 21A, 21B positioned on both opposite sides of exhaust pipe connection wall 21 in the width direction X. Ends of third and fourth exhaust pipes 13, 14 opposite to the ends connected to rear cylinder bank 7B are connected to third and fourth connections 21C, 21D positioned centrally of the exhaust pipe connection wall 21 in the width direction X.

Thus, as shown in FIG. 6, within chamber 20, a distance L1 to mufflers 30 from the sides (21A, 21B) of exhaust pipe connection wall 21 in the width direction X is small and a distance L2 to mufflers 30 from the center (21C, 21D) of wall 21 in the width direction X is large, thereby substantially reducing differences in length among the exhaust pipes.

Also, as shown in FIGS. 3 and 4, connections 21C, 21D are provided in positions more distant, that is, lower than connections 21A, 21B in a vertical direction Y of exhaust pipe connection wall 21.

With such construction, distances from the exhaust ports of rear cylinder bank 7B to connections 21C, 21D become longer, permitting exhaust pipes 13, 14 to become longer in length.

Further, as shown in FIG. 2, the other end sides of exhaust pipes 13, 14 are intersected or intertwined with each other (see an intersecting portion 15 surrounded by a broken line in FIG. 2) near their connections to connections 21C, 21D. More specifically, third exhaust pipe 13 positioned on one side in the width direction X is connected to third connection 21C positioned on the other side in the width direction X, and fourth exhaust pipe 14 positioned on the other side in the width direction X is connected to fourth connection 21D positioned on the one side in the width direction X.

With such construction, exhaust pipes 13, 14 can be made compact and longer without being bypassed in the longitudinal direction Z of the motorcycle 1, so that differences in length among the exhaust pipes are reduced.

The connection between connections 21A-21D of chamber 20 and exhaust pipes 11-14 is now described. As shown in FIG. 6, slits 21*a* extending in the longitudinal direction Z are formed in the vicinity of each of the openings of connections 21A-21D to enable the openings to expand or contract in a radial direction.

After ends of exhaust pipes 11-14 are fitted into the openings of connections 21A-21D, outer peripheries of connections 21A-21D are clamped by metallic annular bodies (not shown) to firmly connect pipes 11-14 to connections 21A-21D.

First expansion chamber 20A of chamber 20, which is defined by a peripheral wall portion in the form of an elliptical cylinder, is now described. As shown in FIGS. 2-6, the peripheral wall portion has upper and lower wall portions and left and right side wall portions that are contiguous to each other without any boundary therebetween. The left and right side wall portions facing each other in the width direction X define muffler connection walls 22

As shown in FIGS. 2, 4 and 5, muffler connection walls 22 are curved convexly toward an outside of motorcycle 1, and a central portion (see an alternate long and short dash lines in FIGS. 4 and 5) thereof (in the vertical direction Y) makes maximum projections 22*a*, 22*a* in the width direction X. Mufflers 30 are connected to muffler connection walls 22 at positions that are higher than maximum projections 22*a* in the vertical direction Y and closer to engine 5 relative to a center P of chamber 20 (see FIG. 5) in the longitudinal direction Z.

Thus, mufflers 30 projecting in the width direction X are mounted in high positions and are inclined along muffler connection walls 22 in the form of a curved surface and inside in the width direction X to decrease the extent to which they project outside of motorcycle 1. As a result, the bank angle of motorcycle 1 provided with exhaust system 8 is increased.

Also, since mufflers 30 are heavy parts and are connected to walls 22 at positions relatively closer to engine 5, the center of gravity is lowered and the mass of motorcycle 1 is concentrated.

As shown in FIGS. 4 and 6, a reinforcement plate 25 for reinforcement of the peripheral wall portion and muffler connection walls 22 is disposed centrally in first expansion chamber 20A. Reinforcement plate 25 prevents deformation of the peripheral wall portion due to pressure changes in chamber 20A caused by exhaust pulsation of engine 5. A multiplicity of different-sized vent holes 25*a* are formed on reinforcement plate 25 to allow passage of exhaust gases flowing into chamber 20A.

A bracket 24 in the form of a lengthy flat plate extending in the width direction X is welded to an upper portion of exhaust pipe connection wall 21, and mount bolts 24*a*, 24*a*, are provided upright on both ends of bracket 24. Mount bolts 24*a*, 24*a* are clamped to a bracket (not shown) on motorcycle frame 2 by nuts, whereby chamber 20, which is a heavy part, is securely held.

Figure 7:
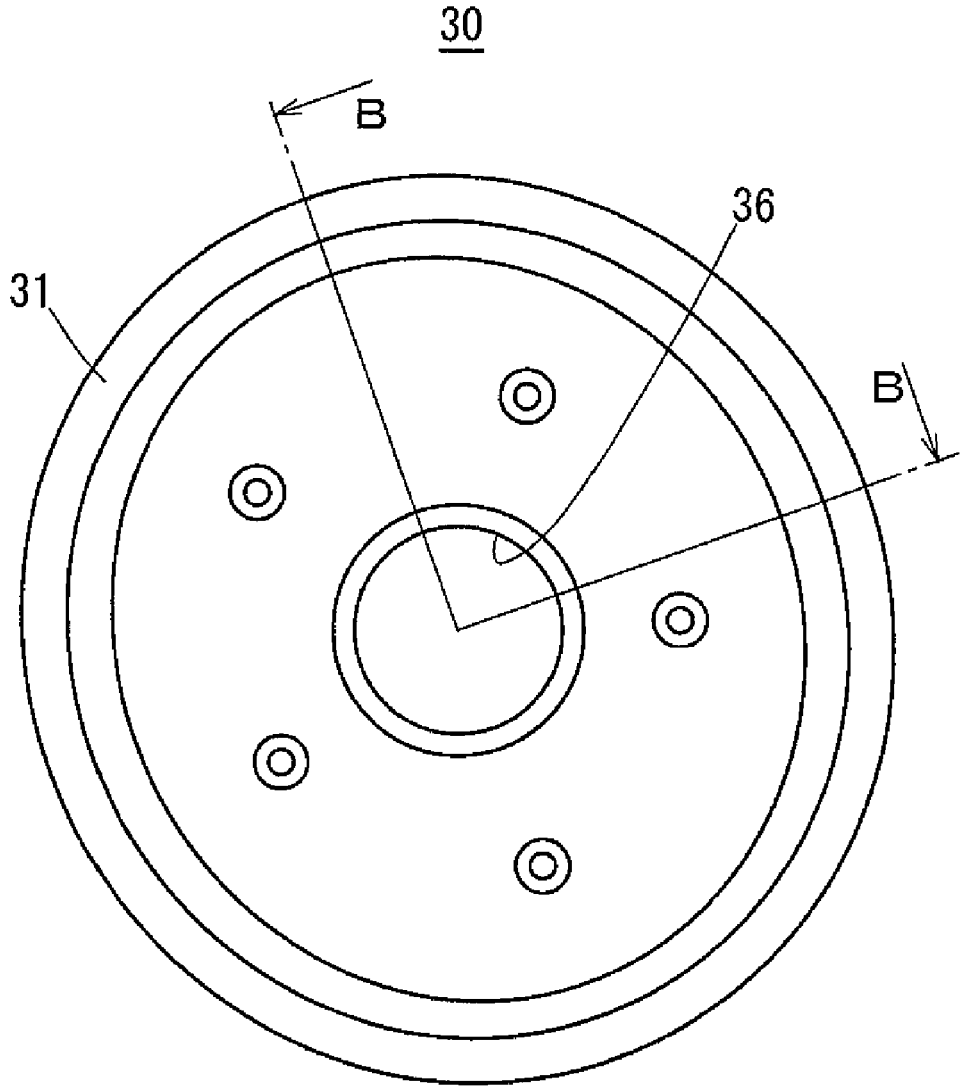
FIG. 7 is a view of the muffler as viewed from a direction indicated by arrow A in FIG. 5.
Figure 8:
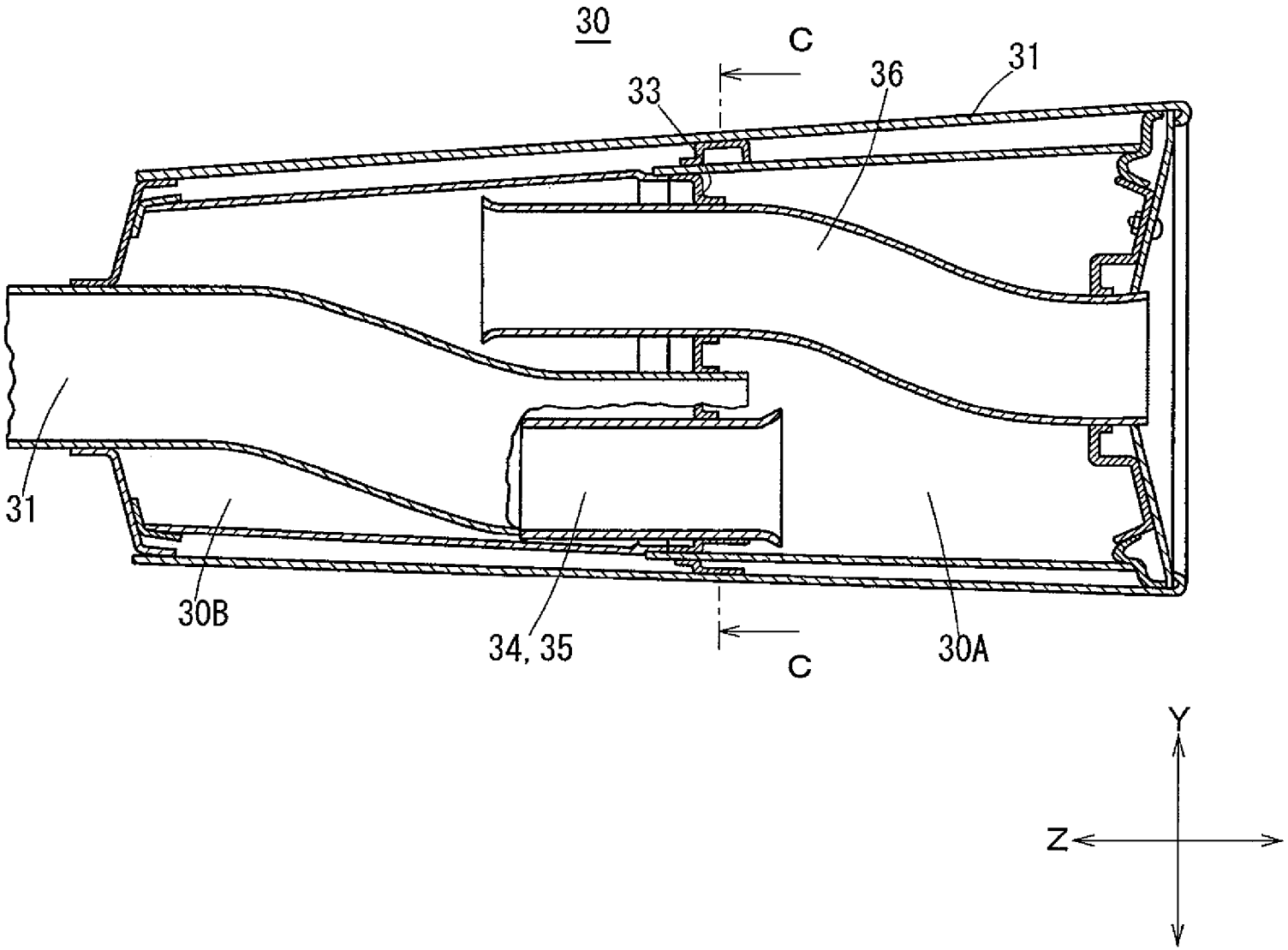
FIG. 8 is a cross sectional view taken along the line B-B in FIG. 7.
Figure 9:
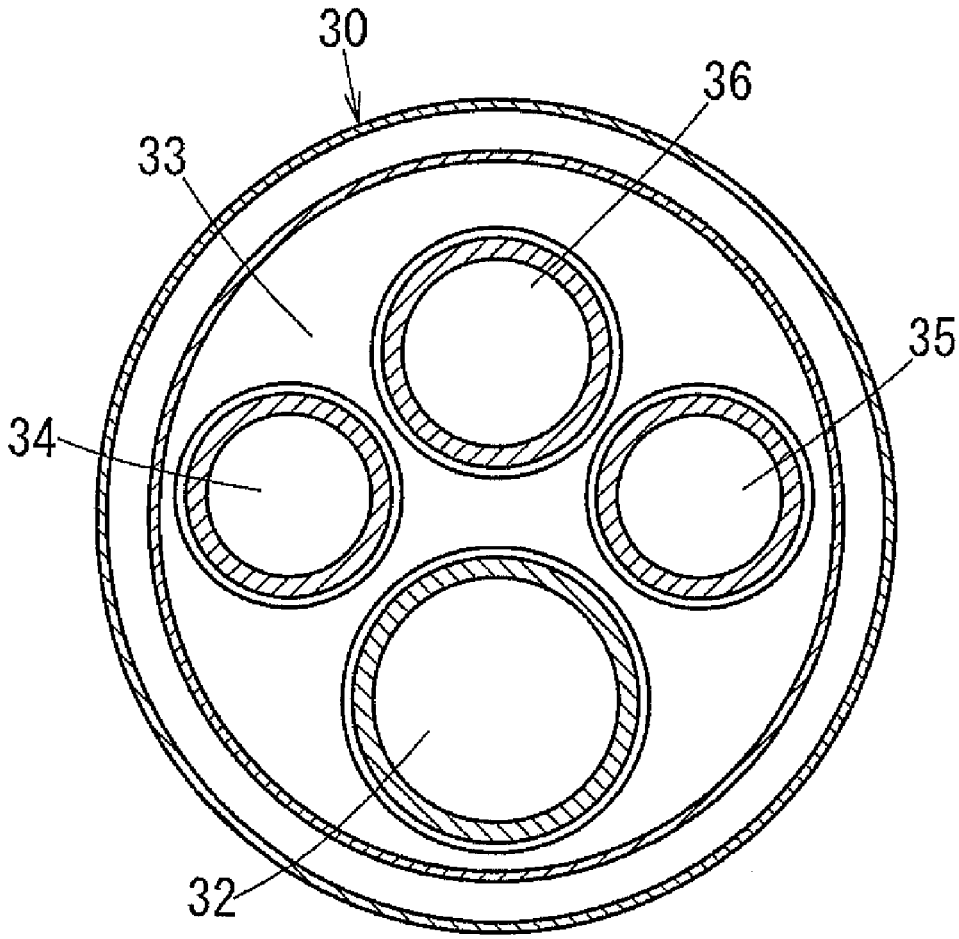
FIG. 9 is a cross sectional view taken along the line C-C in FIG. 8.

Mufflers 30 are now described. FIG. 7 is a view of the muffler in the direction of arrow A in FIG. 5. FIG. 8 is a cross sectional view taken along line B-B in FIG. 7. FIG. 9 is a cross sectional view taken along line C-C in FIG. 8. Mufflers 30 comprise a cylindrical-shaped body 31 substantially in the form of a frustum slightly increased in diameter toward the rear. Second and third expansion chambers 30A, 30B are formed by dividing an interior of body 31 into two parts with a partition 33.

Ends of exhaust gas inflow pipes 32 are introduced into body 31 and pass through third expansion chamber 30B and partition 33 and into second expansion chamber 30A. Communication pipes 34, 35 are extended through and held in partition 33 for communication between second and third expansion chambers 30A, 30B. Exhaust gas outflow pipe 36 extends through and is held in partition 33. One end of pipe 36 is positioned in third expansion chamber 30B and the other end communicates with the outside of body 31.

Brackets 37, 37 are provided on bodies 31 of mufflers 30 to secure the heavy mufflers to the motorcycle.

Thus, one end of exhaust gas inflow pipes 32 leading from the fronts of bodies 31 are connected to muffler connection walls 22 of chamber 20. Thereby, first expansion chamber 20A of chamber communicates through exhaust gas inflow pipes 32 with second expansion chambers 30A of mufflers 30, second expansion chambers 30A communicate with third expansion chambers 30B through communication pipes 34, 35, and third expansion chambers 30B communicate with the outside mufflers 30 through exhaust gas outflow pipes 36.

That is, exhaust gases generated in combustion chambers of cylinder banks 7A, 7B pass through exhaust pipes 11-14 to expand in first expansion chamber 20A of chamber 20. Then, exhaust gases in chamber 20A are compressed when passing through the small-diameter exhaust gas inflow pipes 32 of mufflers 30 and again expand in second expansion chambers 30A. Thereafter, exhaust gases in chambers 30A are compressed when passing through small-diameter communication pipes 34, 35 and again expand in third expansion chambers 30B. Finally, exhaust gases in chambers 30B are compressed when passing through small-diameter exhaust gas outflow pipe 36 to the outside of mufflers 30. In this manner, the exhaust sound is effectively muffled by the repeated expansion and compression of exhaust gases, and output characteristics are improved.

According to the embodiment, exhaust pipes 11-14 are concentratedly connected to exhaust pipe connection wall 21 of chamber 20 and interference with other parts (such as rear wheel Wr), which are mounted on the side of rear wall portion 23, is avoided. Thus, enough space between exhaust pipe connection wall 21 and other parts, which are mounted on the side of rear wall portion 23, is ensured and prevents interference between chamber 20 and other parts. A sufficient volume of first expansion chamber 20A for muffling is ensured by enlarging chamber 20 in an opposite direction to exhaust pipe connection wall 21.

Moreover, mufflers 30 are connected to muffler connection walls 22 at positions closer to engine 5 relative to a center in the longitudinal direction Z so that the center of gravity is lowered and the mass of the motorcycle is concentrated.

According to the embodiment, exhaust pipes 11, 12 of front cylinder bank 7A disposed are disposed relatively distant from exhaust pipe connection wall 21 and are connected to opposite sides of wall 21 in the width direction, and exhaust pipes 13, 14 of rear cylinder bank 7B are disposed relatively closer to wall 21 and are connected to a center portion of wall 21 in the width direction. Thus, within chamber 20, the distance L1 to mufflers 30 from sides (21A, 21B) of wall 21 in the width direction is relatively small and the distance L2 to mufflers 30 from the center (21C, 21D) of wall 21 in the width direction is relatively large, so that differences in exhaust pipe length among exhaust pipes 11-14 is substantially reduced.

Further, according to the embodiment, exhaust pipes 13, 14 of rear cylinder bank 7B are connected to positions lower in the vertical direction Y than positions, to which exhaust pipes 11, 12 of front cylinder bank 7A are connected. Thus, exhaust pipes 13, 14 of rear cylinder bank 7B, which is closer to exhaust pipe connection wall 21, can be lengthened to reduce differences in length among exhaust pipes 11-14.

In addition, according to the embodiment, exhaust pipes 13, 14 have intermediate portions intersecting or intertwining each other (see the intersecting portion 15 in FIG. 2). Thus, exhaust pipes 13, 14 can be made compact and long without being bypassed in the longitudinal direction Z, further reducing differences in length among exhaust pipes 11-14.

Further, according to the embodiment, muffler connection walls 22 of chamber 20 are curved convexly toward an outside of motorcycle 1, and mufflers 30 are connected to positions on walls 22 that are higher than the maximum projections 22*a* in the width direction X of walls 22. Thus, mufflers 30 can be mounted in high positions and are inclined along connection walls 22 in the form of a curved surface and inside in the width direction X to lessen the extent to which they project outside motorcycle 1. As a result, the bank angle of a motorcycle 1 provided with exhaust system 8 is increased.

In addition, according to the embodiment, chamber 20 is arranged rearwardly of pivot shaft 3. Thus, engine 5 and chamber 20 do not overlap each other in the vertical direction Y of motorcycle 1, so that engine 5 is mounted in a further low position to further lower the center of gravity.

The invention is not limited to the embodiments described above. For example, while connections 21C, 21D are described as mounted in "lower positions" than connections 21A, 21B in the vertical direction Y of exhaust pipe connection wall 21 to reduce differences in length among exhaust pipes 11-14, this is not limiting. That is, since differences in pipe length can be reduced by making the positions to which exhaust pipes 13, 14 are connected more distant than the positions to which exhaust pipes 11, 12 are connected, the positions to which exhaust pipes 13, 14 are connected may be shifted as appropriate in vertical direction and/or horizontal (left and right) directions.

Further, while exhaust pipes 13, 14 are described as intersecting or intertwining with each other outside of chamber 20 to reduce pipe length differences, this is not limiting. For example, if exhaust pipes 13, 14 are intersected inside first expansion chamber 20A of chamber 20, the exhaust pipe length differences are also reduced.

Further, while the outer peripheral wall of chamber 20 is described as an elliptical cylinder, in which upper and lower wall portions and left and right side wall portions (muffler connection walls 22) are unified and contiguous with each other without any boundary therebetween, this is not limiting. For example, the outer peripheral wall of chamber 20 may be curved upwardly convexly to be semi-circular or semi-elliptical in shape. When the outer peripheral wall of chamber 20 is shaped in such a manner, there is no distinction between an upper wall portion and left and right side wall portions, so that mufflers 30 may be connected to any positions toward engine 5 on wall surfaces other than a lower wall portion.

The outer peripheral wall of chamber 20 may also assume a rectangular cylinder shape, in which it is possible to distinguish between upper and lower wall portions and left and right side wall portions (muffler connection walls 22), a shape of a triangular prism with its apex upward, or a shape of other polygonal prisms. When the outer peripheral wall of chamber 20 is shaped in such a manner, the muffler connection walls 22 are flat and maximum projections 22*a* are not existent in some cases. In such case, the bank angle of motorcycle 1 can be increased when mufflers 30 are connected to positions on muffler connection walls 22 higher than a center in the vertical direction Y of motorcycle 1.

Figure 2:
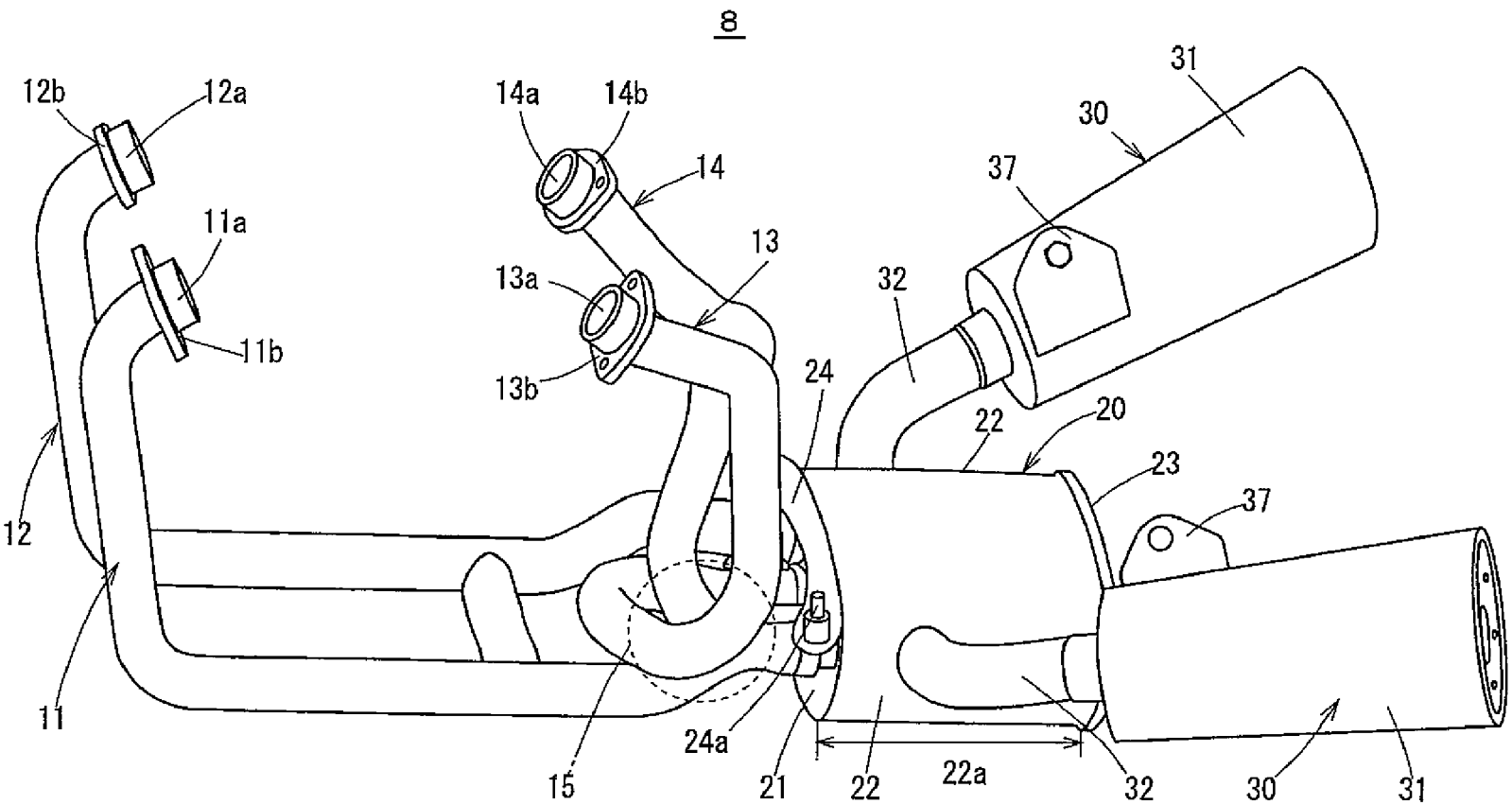
FIG. 2 is a perspective view of an exhaust system according to an embodiment of the invention.

Further, the exhaust system of the invention is not limited in application to a motorcycle as shown in FIG. 1, but is also applicable to other types of vehicles, such as scooters, offroad vehicles, three-wheelers, four-wheel buggies (all-terrain vehicles), snowmobiles and so on.

The particular embodiments of the invention described in this document should be considered illustrative, rather than restrictive. Modification to the described embodiments may be made without departing from the spirit of the invention as defined by the following claims.

The invention claimed is:

1. An exhaust system for a saddle-ride vehicle having an engine, a front cylinder bank and a rear cylinder bank, comprising:

exhaust pipes connected to the front and rear cylinder banks;

a pivot shaft configured to serve as a center of rotation of a support member that swings and supports a rear wheel in a vertical direction;

a chamber for exhaust gases comprising an exhaust pipe connection wall facing a rear wall in a vehicle longitudinal direction, wherein ends of all of the exhaust pipes are connected to the exhaust pipe connection wall, and a pair of muffler connection walls opposed in a vehicle width direction, wherein the chamber is behind the pivot shaft; and mufflers connected to positions on the muffler connection walls that are closer to the engine than a center in the longitudinal direction of the vehicle.

2. The exhaust system according to claim 1, wherein the front cylinder bank is farther from the exhaust pipe connection wall than the rear cylinder bank, and ends of exhaust pipes connected to the front cylinder bank are connected to side portions of the exhaust pipe connection wall in a vehicle width direction, and ends of exhaust pipes connected to the rear cylinder bank are connected to center portions of the exhaust pipe connection wall in the vehicle width direction.

3. The exhaust system according to claim 1, wherein the front cylinder bank is farther from the exhaust pipe connection wall than the rear cylinder bank; and ends of exhaust pipes connected to the rear cylinder bank are connected to the exhaust pipe connection wall at positions more distant from each other than positions from each other to which ends of exhaust pipes connected to the front cylinder bank are connected.

4. The exhaust system according to claim 1, wherein the front cylinder bank is farther from the exhaust pipe connection wall than the rear cylinder bank; and exhaust pipes connected to the rear cylinder bank have intermediate portions that intersect.

5. The exhaust system according to claim 1, wherein the front cylinder bank is farther from the exhaust pipe connection wall than the rear cylinder bank; and exhaust pipes connected to the rear cylinder bank have intermediate portions that intersect; and ends of exhaust pipes connected to the rear cylinder bank are connected to the exhaust pipe connection wall at positions more distant from each other than positions from each other to which ends of the exhaust pipes connected to front cylinder bank are connected.

6. The exhaust system according to claim 1, wherein the mufflers are connected to positions on the muffler connection walls that are higher than a center of the chamber in a vertical direction.

7. The exhaust system according to claim 1, wherein the muffler connection walls are curved convexly toward an outside of the chamber and the mufflers are connected to positions on the muffler connection walls that are higher than a maximum projection of the chamber in a width direction.

8. The exhaust system according to claim 1, wherein the rear wall of the chamber is opposed to the rear wheel.

9. A saddle-ride vehicle comprising the exhaust system according to claim 1.

10. A saddle-ride vehicle comprising the exhaust system according to claim 2.

11. A saddle-ride vehicle comprising the exhaust system according to claim 4.

12. The exhaust system according to claim 1, wherein the mufflers comprise a cylindrical-shaped body substantially in the form of a frustum increased in diameter toward the rear the rear wall of the chamber.

13. The exhaust system according to claim 1, wherein the chamber comprises an expansion chamber having a peripheral wall portion; and a reinforcement plate for the reinforcement of the peripheral wall portion and the muffler connection walls.

14. The exhaust system according to claim 13, wherein a plurality of different-sized vent holes are formed on the reinforcement plate.

* * * * *